US008264410B1

(12) United States Patent
Wang

(10) Patent No.: US 8,264,410 B1
(45) Date of Patent: Sep. 11, 2012

(54) PLANAR BROADBAND TRAVELING-WAVE BEAM-SCAN ARRAY ANTENNAS

(75) Inventor: Johnson J. H. Wang, Marietta, GA (US)

(73) Assignee: Wang Electro-Opto Corporation, Marietta, GA (US)

( * ) Notice: Subject to any disclaimer, the term of this patent is extended or adjusted under 35 U.S.C. 154(b) by 1197 days.

(21) Appl. No.: 11/831,002

(22) Filed: Jul. 31, 2007

(51) Int. Cl.
*H01Q 1/38* (2006.01)

(52) U.S. Cl. ..... 343/700 MS; 343/731; 343/792.5

(58) Field of Classification Search ..... 343/700 MS, 343/731, 737, 792.5, 795, 806, 809, 811–814, 343/824, 846, 848
See application file for complete search history.

(56) References Cited

U.S. PATENT DOCUMENTS

| | | | | |
|---|---|---|---|---|
| 5,313,216 | A | 5/1994 | Wang et al. | |
| 5,483,248 | A * | 1/1996 | Milroy | 343/785 |
| 5,508,710 | A | 4/1996 | Wang et al. | |
| 5,621,422 | A | 4/1997 | Wang | |
| 5,936,595 | A | 8/1999 | Wang | |
| 6,094,172 | A * | 7/2000 | Koscica et al. | 343/731 |
| 6,137,453 | A | 10/2000 | Wang et al. | |
| 6,323,809 | B1 | 11/2001 | Maloney et al. | |
| 6,512,487 | B1 | 1/2003 | Taylor et al. | |
| 6,771,221 | B2 | 8/2004 | Rawnick et al. | |
| 6,876,336 | B2 | 4/2005 | Croswell et al. | |
| 6,972,729 | B2 * | 12/2005 | Wang | 343/833 |
| 7,202,818 | B2 * | 4/2007 | Anguera Pros et al. | 343/700 MS |
| 7,250,908 | B2 * | 7/2007 | Lee | 343/700 MS |
| 7,701,394 | B2 * | 4/2010 | Hook et al. | 343/700 MS |
| 7,705,782 | B2 * | 4/2010 | Lee | 343/700 MS |
| 2005/0259008 | A1 * | 11/2005 | Gustafsson | 343/700 MS |
| 2007/0159396 | A1 * | 7/2007 | Sievenpiper et al. | 343/700 MS |

OTHER PUBLICATIONS

Tang, Raymond and Burns, Richard W.; Phased Arrays, 1993, McGraw-Hill, pp. 20.5-20.7.*

Wang, J.J.H.; , "The physical foundation, developmental history, and ultra-wideband performance of SMM (spiral-mode microstrip) antennas," Antennas and Propagation Society International Symposium, 2005 IEEE , vol. 3A, No., pp. 586-589 vol. 3A, Jul. 3-8, 2005, found at: http://ieeexplore.ieee.org/stamp/stamp.jsp?tp=&arnumber=1.*

Kasahara, Takeshi; Mushiake, Yasuto; "Four-Terminal Circularly Polarized Self-Complementary Antennas", Electronics and Communication in Japan, vol. 65-B, No. 8, 1982).*

Deschamps, G. A. "Impedance Properties of Complementary Multiterminal Planar Structure," IEEE Trans. Antennas and Prop. vol. 7, No. 5, pp. S371-S378, Dec. 1959.

DuHamel, H. D., et al., "Frequency Independent Antennas," in Antenna Engineering Handbook, 3rd ed., R. C. Johnson, Editor, McGraw-Hill, New York, 1993, Chpt. 14.

Friederich, P., et al., "A new class of broadband planar aperture," Antennas Applications Symposiums, Unv. of IL, 2001.

(Continued)

*Primary Examiner* — Tan Ho
(74) *Attorney, Agent, or Firm* — Thomas, Kayden, Horstemeyer & Risley, LLP

(57) ABSTRACT

A planar broadband beam-steering phased array antenna with approximately 10:1 bandwidth is comprised of planar broadband traveling wave antenna elements positioned parallel to a conducting ground plane and spaced less than 0.5 wavelength at the highest operating frequency and more than 0.01 wavelengths at the lowest operating frequency. Each planar traveling wave antenna element is a planar frequency-independent antenna or planar self-complementary antenna, and is truncated to fit a unit cell of the phased array. Adjacent antenna elements are arranged to be tightly coupled together or connected with each other and spaced less than 0.5 wavelength apart between their centers throughout its operating frequency range. One or more layers of dielectric or magneto-dielectric substrates/superstrates can be added to enhance specific performances.

12 Claims, 7 Drawing Sheets

OTHER PUBLICATIONS

Hansen, R. C., "Dipole Array Scan Performance over a Wide-Band," IEEE Trans. Antennas and Prop. vol. 47, No. 5, pp. 956-957, May 1999.
Lee, J. J., "Ultra Wideband Arrays," in Antenna Engineering Handbook, 4th ed. By J. L. Volakis, McGraw-Hill, New York, 2007, Chapter 24.
Matthaei, G., L. Young, et al., "Microwave Filters, Impedance-Matching . . . Structures", McGraw-Hill, NY, 1964, reprinted by Artech House, Norwood, MA in 1985, Chptr. 11.
Mailloux, R. J., Phased Array Antenna Handbook, Artech House, Boston, 1994, Chapter 2.
Mayes, P. E., "Frequency Independent Antennas," in Antenna Handbook, Y. T. Lo and S. W. Lee, Editors, Van Nostrand Reinhold, NY, 1988., Chpt. 9.
Munk, B. A., "A Wide Band, Low Profile Array of End Loaded Dipoles with Dielectric Slab Compensation," Proc. European Conf. Antennas and Propag., Nice, FR, p. 9.1, Nov. 2006.
Munk, B. A. and J. B. Pryor, "Common Misconceptions Regarding Arrays with a Groundplane," JINA 2002 International Symposium on Antennas, Nice, France, Nov. 2002.
Munk, B., R. Taylor, et al., "A Low-Profile Broadband Phased Array Antenna," 2003 IEEE International Symposium on Antennas and Propag., Columbus, OH, pp. 448-451, Jun. 2003.
Y. Mushiake, "A Report on Japanese Development of Antennas: From the Yagi-Uda Antenna to Self-Complementary Antennas," IEEE Antennas & Propagation Mag., vol. 46, No. 4, Aug. 2004.
Pozar, D. M., "The Active Element Pattern," IEEE Trans. Antennas and Prop. vol. 42, No. 8, pp. 1176-1178, Aug. 1994.
Pringle, L., et al., "Architecture and Performance of a Reconfigurable Apertures," Antennas Applications Symposium, University of Illinois, 2001.
Thors, B., et al., "Broad-Band Fragmented Aperture Phased Array Element Design Using Genetic . . . ," IEEE Trans. Antennas and Prop., vol. 53, No. 10, pp. 3280-3287, Oct. 2005.
Walter, C. H., Traveling Wave Antennas, McGraw-Hill, New York, NY, 1965.
Wang, J. J. H., Generalized Moment Methods in Electromagnetics Formulation and Computer Solution of Integral Equations, Wiley, New York, 1991, Chapter 10.
Wang, J. J. H., "The Spiral as a Traveling Wave Structure for Broadband Antenna Applications," Electromagnetics, 20-40, Jul.-Aug. 2000.
Wang, J. J. H., et al., "Broadband/Multiband Conformal Circular Beam-Steering Array," IEEE Trans. Antennas and Prop. vol. 54, No. 11, pp. 3338-3346, Nov. 2006.
Wheeler, H. A., "Simple Relations Derived from a Phased-Array Antenna Made of an Infinite Current Sheet," IEEE Trans. Antennas and Prop. vol. 13, pp. 506-514, Jul. 1965.

* cited by examiner

PLANAR BROADBAND TRAVELING-WAVE BEAM-SCAN ARRAY ANTENNAS

TECHNICAL FIELD

The present invention is generally related to radio-frequency antennas and, more particularly, broadband planar beam-scan array antennas.

BACKGROUND OF THE INVENTION

Broadband planar array antennas have become increasingly more important for both military and commercial applications. The broadband requirement is driven by the proliferation of wireless systems operating at different separate frequencies and the need for high speed. The planar form factor is desirable and often necessary for both transport and installation of the array antenna, because of the associated features of low profile and conformability to platform. The planar form also lends itself to low weight and low-cost production methods such as a printed-circuit board.

The planar array antenna consists of identical and generally equally-spaced element antennas periodically positioned on a planar surface (the x-y plane) of the array antenna, as depicted in FIG. 1. The periodicity is along two generally oblique coordinates, $s_1$ and $s_2$, which allows us to divide the plane into similar unit cells, with the center cell abcd shown in the figure. Although the arrangement of FIG. 1 shows only 9 unit cells, an infinite number of cells are implied here. (Note that while a real phased array must be finite in size, in theory an array of infinite extent is often assumed. The infinite planar array model greatly simplifies the theoretical problem, and has been well established since its introduction four decades ago.)

The array elements are fed by the feed and beam steering network, as depicted in the cross-sectional view of the array in FIG. 2, to generate a selected amplitude and phase distribution in the array elements so that they form a main beam in a desired direction. The antenna beam is scanned or steered by variation of the phase of the elements by means of their phase shifters; thus the antenna is called a phased array. Although the discussion herein is for the case of transmit, by reciprocity it applies also to the case of receive.

Although the possibility of broadband planar beam-scan array had been envisioned four decades ago (Wheeler, 1965), the design of broadband planar arrays has been mostly focused on arrays using 3-dimensional (3-D) elements such as the flared slots. 3-D elements have a large dimension perpendicular to the plane of the array (along the z axis), thus are not amenable to many low-cost production techniques. As a result, research efforts have been launched since late 1990s to explore the use of 2-dimensional (2-D) array elements, such as planar patches, flat dipoles, and slots, in planar arrays. Findings so far have shown that planar arrays of 2-D elements have the potential of wide bandwidths, large scan angle, as well as reduced thickness and weight. Since planar beam-scan arrays with 2-D elements are amenable to truly low-cost printed-circuit-board production, their potential applications in the commercial and military markets are recognized.

Hansen (1999) showed that a planar phased array using planar dipoles, without a ground plane, exhibits easy-to-match active resistance and fairly stable element gain pattern, over a wide range of scan angles and bandwidth (over 5:1). Yet the reactance remains to be matched over the frequency. Also, since this array does not have a ground plane, it has a bidirectional radiation pattern (on both sides of the array plane). The resulting bidirectional radiation renders this planar array unsuitable for applications in which conformal mounting on a platform is required. When Hansen added a ground plane to one side of array to suppress its back radiation, he noted disruptive effects. Therefore, Hansen's array is impractical, just like Wheeler's array, until a ground plane is added.

Following Hansen's reporting, research efforts in planar arrays soon escalated, essentially following two approaches: the Current Sheet Antenna (CSA) and the Fragmented Aperture (FA).

The CSA approach was taken by Munk and his associates (Munk, 2006; Munk and Pryor, 2002; Munk et al, 2003) and is related to several U.S. patents (U.S. Pat. Nos. 6,512,487 B1, 2003; 6,771,221 B2, 2004; 6,876,336 B2, 2005). The CSA is based on the use of planar dipoles as the array element antennas, having a ground plane spaced less than 0.5-wavelength at the highest operating frequency. Their CSA claims a 10:1 bandwidth, yet has only disclosed scant data to support it. Also, a slot-version of CSA has been pursued by Lee and his associates (J. J. Lee, 2007) with a claim of 4:1 bandwidth.

The FA has been reported by Friedrich and his associates (Friedrich et al, 2001; Pringle et al, 2001), and has a U.S. Pat. No. 6,323,809 B1, 2001. The FA employs a multilayer structure with real-time reconfiguration to realize a set of radiating elements and a ground conducting plane generally spaced ¼-wavelength therefrom for the particular operating frequency of interest. The FA approach relies on design optimization processes to generate an optimum array design. Claiming a wide operating bandwidth much more than 10:1, the FA approach has insufficient supporting data in the open literature. The viability of the technique of a movable ground plane by reconfiguration, as claimed in the FA approach, was questioned categorically by Munk and Pryor (2002).

Indeed, as observed by Thors et al (2005), design guidelines and results are often scant or nonexistent in the documents on CSA and FA. It must be emphasized that, even though extremely broad bandwidth can be easily designed for the case of planar arrays of 2-D elements with no supporting ground plane, design of broadband planar array having a ground plane is difficult. This is particularly true in the case of the FA approach, for which Thors et al only managed to achieve a bandwidth of 2.23:1.

This inventor noted that the theory and experimentation on CSA and FA disclosed to the public often are indirect and incomplete, and have not yet realized full-fledged broadband performance as claimed. He also noted some limitations and deficiencies in certain design concepts of CSA and FA, which consist of inherently narrowband components whose bandwidths are difficult to broaden by reconfiguration or optimization. He then conceived the present invention based on the traveling-wave (TW) antenna concept, which potentially has superior performance over prior-art approaches.

SUMMARY OF THE INVENTION

The present invention is a planar broadband phased array antenna capable of wide-angle beam scan. It comprises an array of planar broadband traveling-wave (TW) antenna elements positioned parallel to a conducting ground plane spaced less than 0.5 wavelength therefrom at the highest operating frequency, and more than 0.01 wavelength at the lowest operating frequency. The array is preferably thin, and sometimes flexible and conformable to a surface that may not be strictly flat. The conducting ground plane ensures that the planar array antenna radiates only to the hemisphere on one side of the array, and is also part of the structure that supports the propagation of a TW along the plane of the array.

Each planar TW antenna element is a planar 2-D frequency-independent (FI) antenna truncated to fit the unit cell of the phased array. The planar FI antenna, as discussed in the literature (DuHamel and Scherer, 1993; Mayes, 1988; Y. Mushiake, 2004), can be a log-periodic (LP) type, the self-complementary (SC) type, the sinuous type, etc. The feed portion of each TW antenna element comprises two pairs of transmission lines to support dual-orthogonal or circular polarization. Each TW antenna element comprises a medial feed portion and radiates in the direction normal to the ground plane.

To avoid the grating lobe problem, it is desirable that the spacing between centers of adjacent array elements be less than ½-wavelength at the highest operating frequency. Consequently, a phased array of ultrawide bandwidth is a densely packed array. Adjacent antenna elements are arranged to be intensely coupled or connected with each other.

One or more layers of dielectric or magneto-dielectric substrates can be placed between the planar TW antenna elements and the ground plane, or as superstrate placed above the TW antenna elements, or both, for enhancement of specific performances.

BRIEF DESCRIPTION OF THE DRAWINGS

Many aspects of the invention can be better understood with reference to the following drawings. The components in the drawings are not necessarily to scale, emphasis instead being placed upon clearly illustrating the principles of the present invention. Moreover, in the drawings, like reference numerals designate corresponding parts throughout the several views.

DETAILED DESCRIPTION OF THE INVENTION

The Physical Structure

Figure 1:
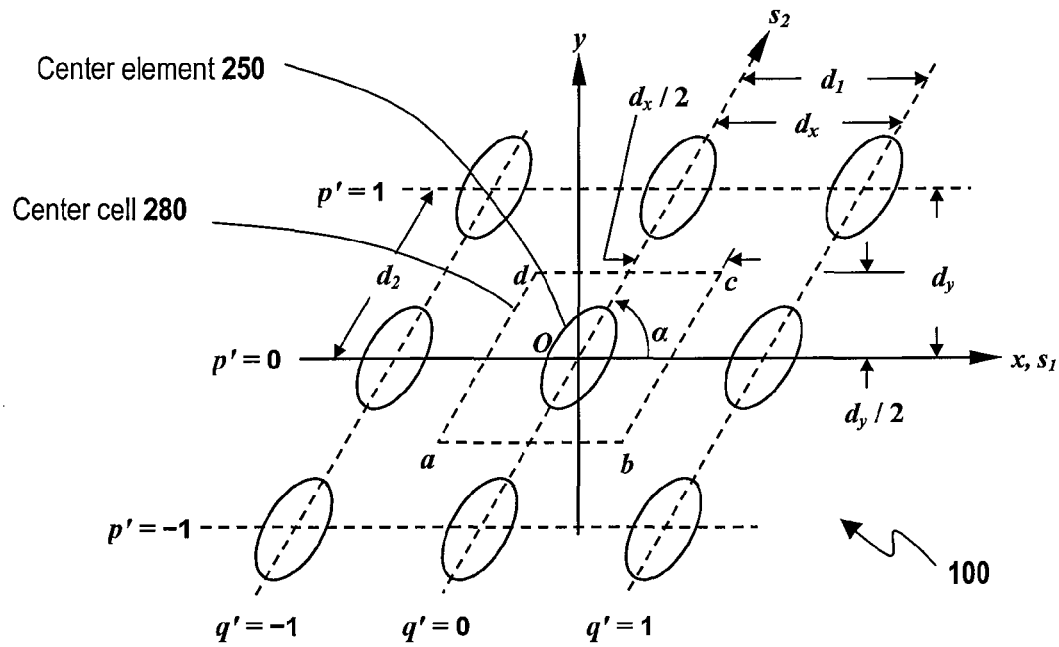
FIG. 1 is a top view of a planar array of periodic elements.
Figure 2:
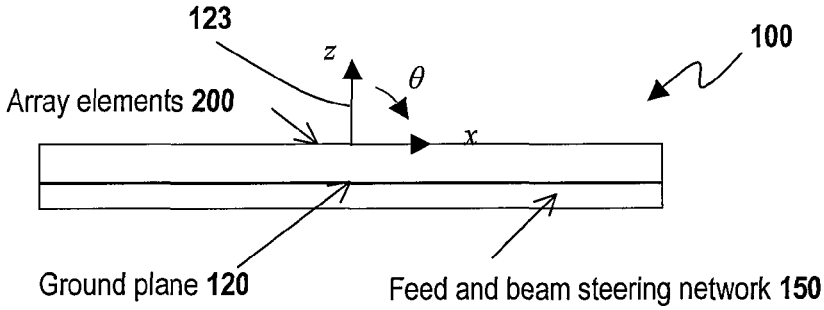
FIG. 2 is a cross-sectional view of a planar array of periodic elements in FIG. 1.

As depicted in the top view in FIG. 1 and a cross-sectional view in FIG. 2, a planar array antenna 100 is perpendicular to the axis z labeled 123. Array antenna 100 consists of an array of identical and generally equal-spaced traveling-wave (TW) element antennas, which are collectively labeled 200. The array element antennas 200 is a thin planar array structure backed by a conducting ground plane 120 and fed by beam-steering network 150. Individual array element antennas, such as the center element 250, are periodically positioned on a planar surface (the x-y plane) of the array antenna perpendicular to the z-axis 123. The periodicity is along two generally oblique coordinates, $s_1$ and $s_2$, which allows us to divide the planar array into similar unit cells, such as the central cell 280 marked by the parallelogram abcd. Each unit cell, such as the center cell 280, contains a physical element antenna, such as the corresponding center element 250, as shown in FIG. 1. When $x=s_1$ and $y=s_2$, the unit cells become square or rectangular in shape.

A rigorous theory has been developed for planar arrays of infinite extent, which are amenable to analyses by expansions of Floquet modes. In an infinite planar array, the radiation characteristics of any element, or unit cell, are similar to those of the center element 250 or center cell 280, respectively. In experimentation, arrays are of course of finite dimensions; yet most of the elements in an array are not close to the edge and thus can be considered to be in an array environment of infinite extent. Analyses and measurements on finite arrays have validated this theory of infinite planar array, which is further supplemented by treating the elements near the edge of a planar array in a refined design approach. The details will be further discussed in a later section on the theory of this invention.

The TW array elements, collectively labeled 200, are identical two-dimensional (2-D) structures in the x-y plane, which are spaced more than 0.01 wavelength and less than 0.5 wavelengths away from a parallel conducting ground plane 120 in order to support a desired dominant mode of TW in the array structure and suppress higher-order modes of TW. Array elements 200 are thin planar structures fed individually by the feed and beam steering network 150, as depicted in the cross-sectional view of the array in FIG. 2. The conducting part of the array elements 200 is very thin, generally much less than 1 mm in thickness, but must be thicker than the skin depth for the operating frequencies. The resulting electric and magnetic currents in the array elements, as source currents, generate a main radiation beam in the far field in a desired direction dictated by the amplitude and phase distribution of the source currents. As a phased array, the antenna beam is scanned or steered by varying the phases of the array elements by means of their phase shifters.

Figure 3:
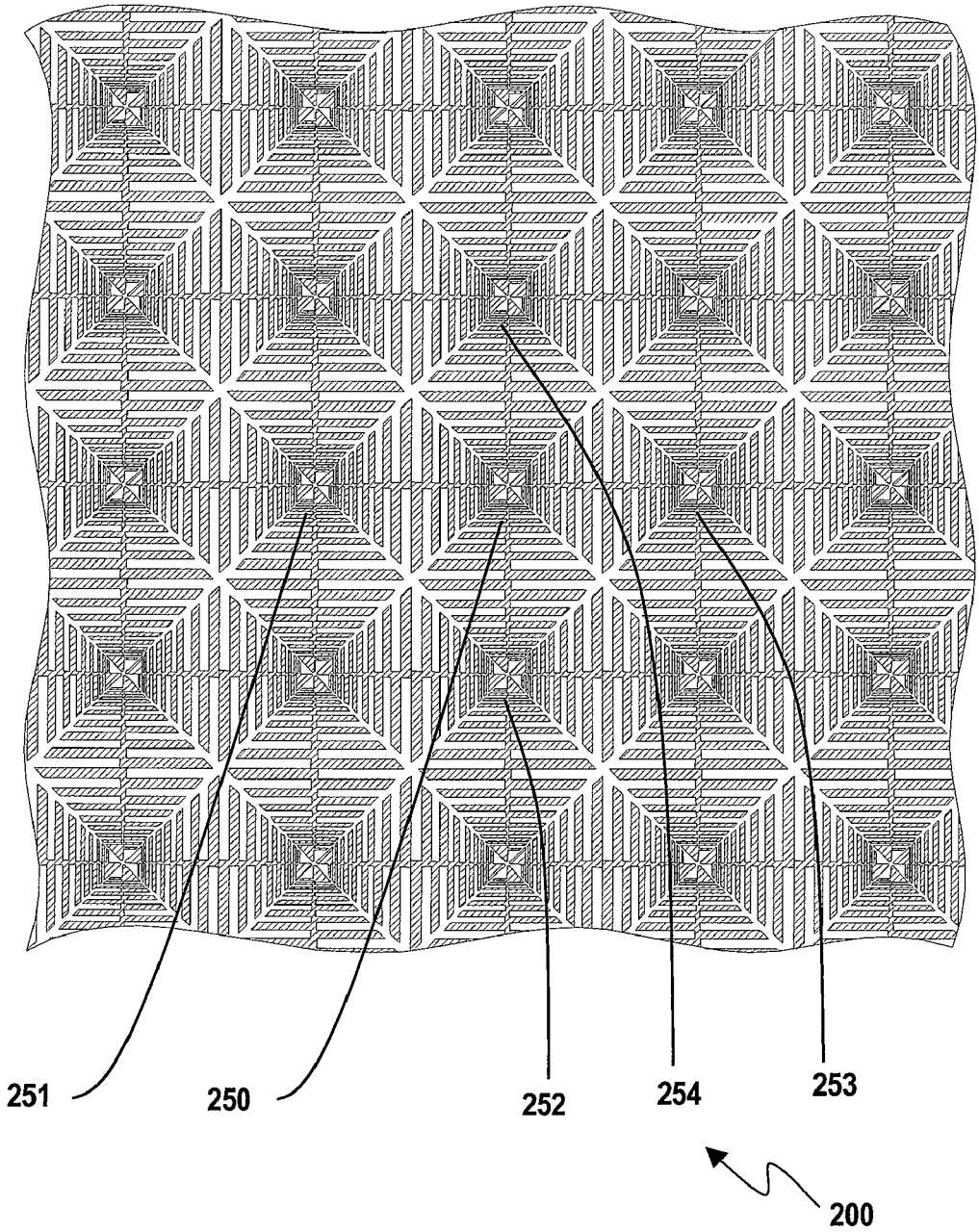
FIG. 3 is a top view of a planar array of 2-D LP traveling-wave element antennas.
Figure 4:
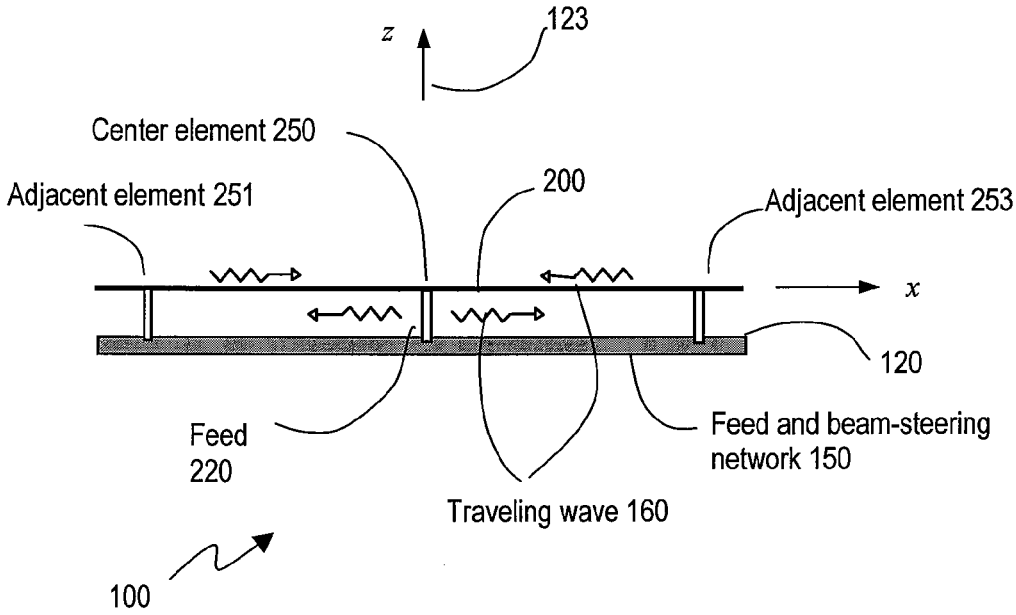
FIG. 4 is a side cross-sectional view of the array in FIG. 3 around its center element.

FIGS. 3 and 4 show, respectively, a top view and a cross-sectional view cut through the x-z plane for the first embodiment of the present invention, which employs planar 2-D TW element antennas, forming a broadband planar array elements 200. The entire planar array consists of unit cells which are structurally similar and connected with one another. The centers of adjacent antenna elements, or array cells, are spaced less than 0.5 wavelengths apart for suppression of the undesirable grating lobes. The centers of adjacent antenna elements are also spaced more than 0.1 wavelength at the lowest operating frequency to minimize power dissipated into adjacent feeds, since they are electrically coupled or connected with each other.

Figure 5:
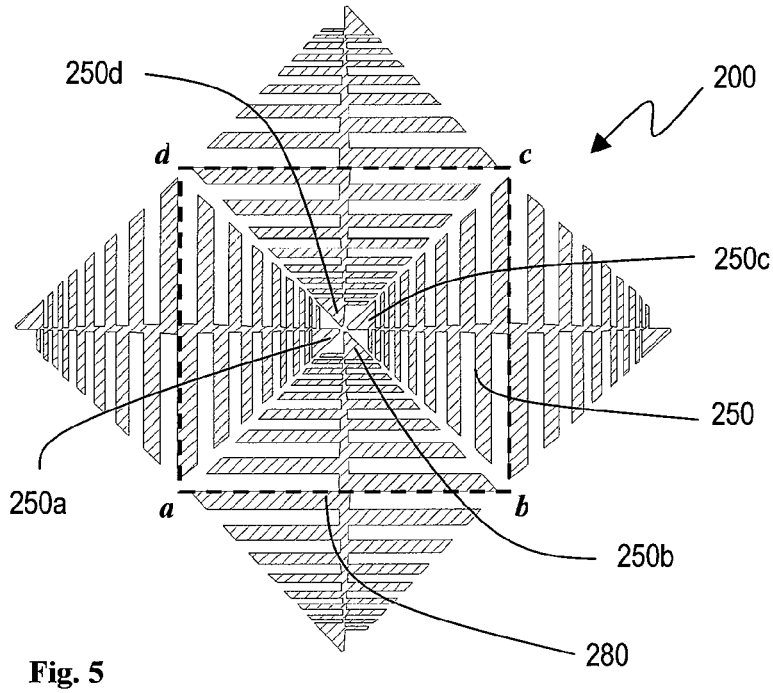
FIG. 5 is a top view of the array in FIG. 3 around its center element having four feed points.

Let us first focus on the center TW element 250, which is connected with adjacent TW elements 251, 252, 253, and 254, as shown in FIGS. 3 and 5. All the individual units in array elements 200, such as elements 250, 251, 252, 253, and 254, are structurally similar, and are each defined by a unit cell as shown in FIGS. 1 and 5. Since the adjacent elements are connected here, each array element coincides with its unit cell. For example, the center unit cell 280, which is the planar region within abcd, coincides with the array center element 250, as depicted in FIGS. 1 and 5.

The unit cell abcd in FIG. 5 has four similar LP (log periodic) sub-elements joining at the center of the cell. The TW antenna element 250 comprises a medial cluster of four terminal feed points, 250*a*, 250*b*, 250*c*, and 250*d*, which are connected to the feed and beam-steering network 150 via a feed 220. The feed and beam-steering network 150 is then connected to a transceiver and beam-steering computer. A TW 160 generated at the feed cluster propagates along the planar array 200, and radiates into the free space with a main beam directed at an angle above the array plane as dictated by the phase distribution in array elements 200. Although the discussion here is for the case of transmit, by reciprocity it applies also to the case of receive.

Each TW antenna element is a planar frequency-independent (FI) antenna, as has been extensively defined and covered in the literature (DuHamel, H. D. and J. P. Scherer, 1993; Mayes, P. E., 1988). Each FI element antenna is truncated to fit into the unit cell of the phased array. The FI planar antenna can be a log-periodic (LP) type (as displayed in FIG. 3), the self-complementary (SC) type, or the sinuous type, etc. The feed portion of each TW antenna element, as shown in FIG. 5, comprises a cluster of four terminals, which are connected with the feed network 150 below the ground plane 120 via two pairs of transmission-line feeds 220. The feed 220 has two pairs of balanced transmission lines, which are connected with the center element 250 at their two pairs of feed points, (250*a*, 250*c*) and (250*b*, 250*d*), respectively.

The feed 220 consists of two balanced transmission lines of the twin-lead type. The two pairs of feed points, (250*a*, 250*c*) and (250*b*, 250*d*), are orthogonal to each other so that they can support dual-orthogonal polarization for the array element antenna 250 if the signals are processed separately, or a linear, elliptical, or circular polarization if the signals are combined with an appropriate phase relationship between. For circular polarization, the two signals at the orthogonal pairs of feed points, (250*a*, 250*c*) and (250*b*, 250*d*), must be equal in amplitude and have a phase difference of 90°. For other amplitude and phase differences between the two signals at the pair of feed points, the polarization of the combined radiated signal of this element antenna will be elliptical or linear. The sense of the circular polarization, or elliptical polarization, will depend on which pair of feeds leads in phase, and will be either right-hand or left-hand.

The transmission-line feeds 220 and feed and beam-steering network 150 are designed to match the broadband impedance of the planar FI array elements 200, which has been established by the analysis on complementary multiterminal planar structures without the ground plane 120 (Deschamps, 1959). General techniques for broadband impedance matching can be found in the book by Matthaei et al (1964, reprinted 1980).

Figure 6:
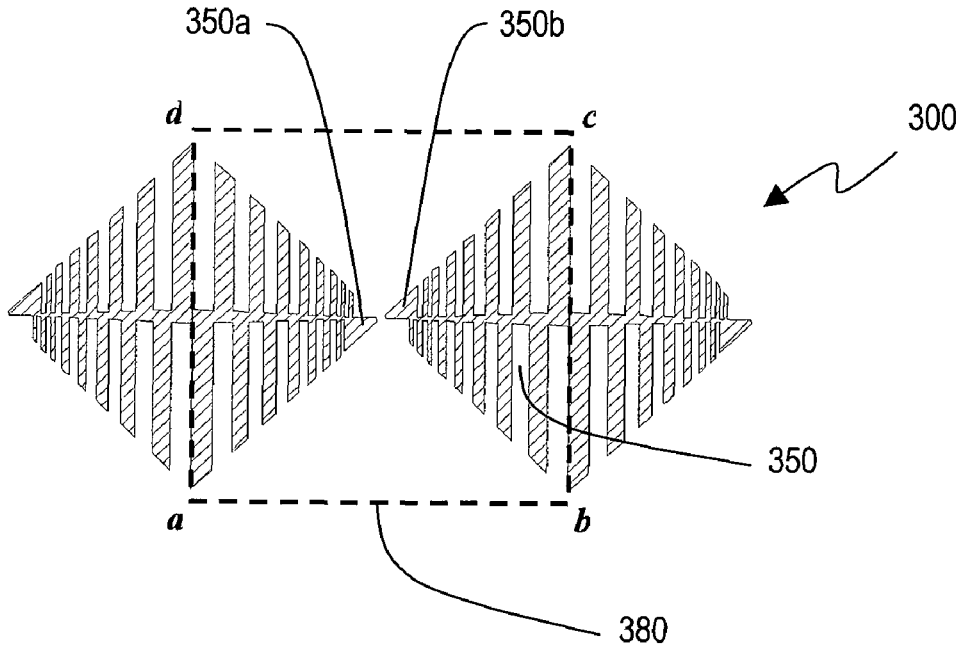
FIG. 6 Is a top view of a center element LP TW antenna having two feed points.
Figure 7A:
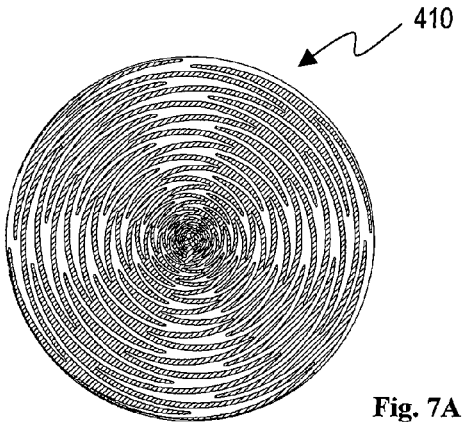
FIGS. 7A-7E are drawings showing five types of frequency-independent elements.
Figure 7B:
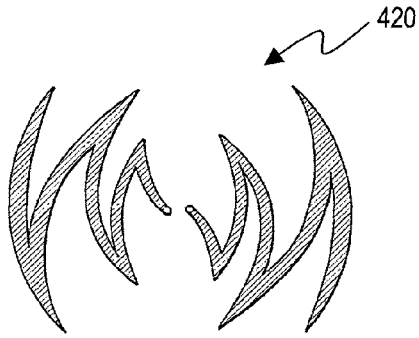
Figure 7C:
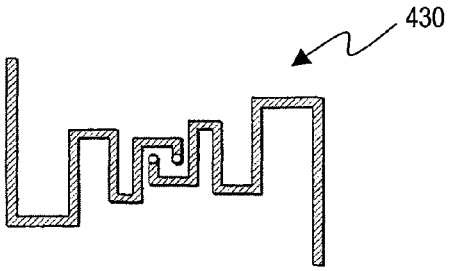
Figure 7D:
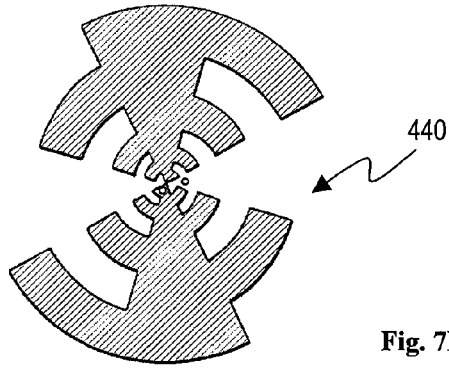
Figure 7E:
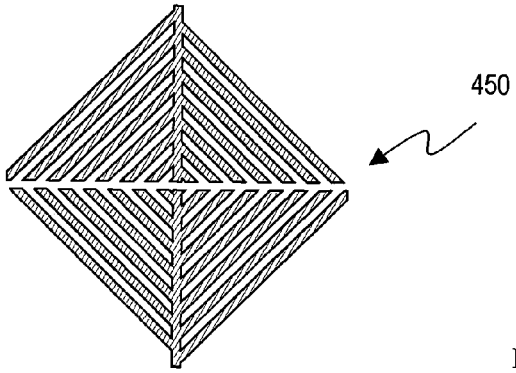

As a variation, FIG. 6 shows a TW element 350, which is enclosed in the unit cell 380 as marked by the rectangle abcd in a planar TW array 300. The TW element 350 has a cluster of two feed terminals, 350*a* and 350*b*, which are fed with a signal from the output of a balun feed 220 shown in FIG. 4. The balun is a device that matches between an unbalanced transmission line and a balanced transmission line. It serves the dual functions of impedance matching and transformation of the transmission lines between balanced and unbalanced modes. In the present case, the balanced transmission line output of the balun is connected with the antenna input terminals, 350*a* and 350*b*; and the unbalanced transmission line output is connected with the feed and beam-steering network 150 which generally is in an unbalanced transmission line mode such as microstrip line, coaxial cable, etc. In FIG. 6, feed terminal pair 350*a* and 350*b* generate a TW of a linear polarization in element 300 due to the structural symmetry and source excitation. The linear-polarization case of 350 is simpler to describe than the element 250 which can support dual-orthogonal polarization or circular polarization, but it is not as broadband since it is not close to a self-complementary antenna, even though it is of the FI type.

FIGS. 7A, 7B, 7C, 7D and 7E show other planar FI TW element antennas 410, 420, 430, 440, and 450 which can be employed to form planar array 200.

Theoretical Basis of the Invention

It is noted that prior-art approaches for broadband planar arrays either use narrowband dipole/slot as building blocks, or relying on reconfiguration during operation, to achieve broadband. In the present invention, frequency-independent (FI) planar (2-D) element antennas are employed, with the adjacent elements connected or strongly coupled, to form the planar array.

Without loss of generality, the theory of operation can be explained by considering the case of transmit; the case of receive is similar on the basis of the principle of reciprocity. Referring to FIGS. 4 and 5, a traveling wave (TW) 160 is launched at the center of each element antenna, and emitted radially outward from the feed center of the element 250. The TW is impedance matched to the TW array structure for propagation radially outward along the array surface 200. In addition, the TW array structure is configured so that radiation from the TW takes place rapidly and most of the power in the TW has been radiated before reaching the feed of the adjacent elements. The rapidity and efficiency of the radiation is also facilitated by having adjacent antenna elements spaced more than 0.1 wavelength, center to center, at the lowest operating frequency to minimize power dissipation into adjacent feeds, which are electrically connected, or strongly coupled, with each other. Adjacent antenna elements are also spaced less than 0.5 wavelengths apart in order to suppress the undesirable grating lobes.

Impedance matching is crucial to the performance of the array, and must be achieved over the broad bandwidth from the feed and beam-steering network 150 to the feed 220, to medial four-terminal feed cluster, 250*a*, 250*b*, 250*c*, and 250*d*, and onto the TW array structure. Success in broadband impedance matching is rooted in the broad bandwidth of the TW structure, which consists of the planar FI element antennas and properly positioned conducting ground plane in the present invention. The FI array elements 200 and the closely spaced conducting ground plane 120 form a broadband TW structure that supports a variety of broadband transmission line and waveguide modes as well as modes of broadband radiation.

The theoretical foundation supporting the present invention can be found in the literature. A rigorous treatment on the basic theory and numerical analysis of planar arrays can be found in Wang (1991) and Mailloux (1994). Discussions on the traveling-wave antennas in general can be found in Walter (1965). General impedance matching techniques for multistage transmission lines and waveguides are in the literature (e.g., Matthaei et al, 1964, reprinted 1985).

The radiation of the present broadband planar TW array is discussed as follows. The basic physics of the planar TW array is largely similar to that of the broadband planer TW antennas discussed in Wang (2000) and Wang et al (2006). By invoking the equivalence principle and image theory, as shown in FIG. 8A, the planar array antenna 100 can be represented, for its fields in the half space above the array plane (i.e., for z>0), as an equivalent magnetic current M, labeled 180, immediately above an electric conducting plane 190, where $$M=-n\times E=-\hat{z}\times E \tag{1}$$

And E is the electric field on the planar surface of the array at z=0.

Figure 8A:
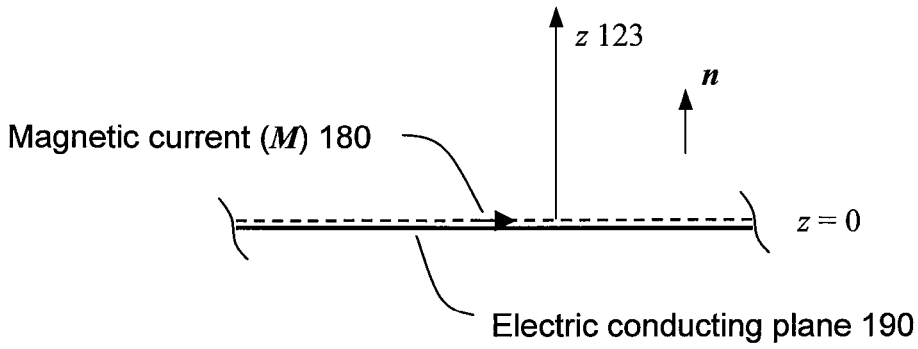
FIG. 8A is representation of planar array of FIG. 1 for the half-space above the array by an equivalent magnetic current backed by a conductor.

Note here that the conducting plane 190, as shown in FIG. 8A, is not the same ground plane 120; rather, it is a fictitious conducting plane positioned immediately below, and infinitesimally close to, the array surface at z=0, namely, at z=0−. Note also that only the "slot" part of the array has a non-vanishing magnetic current M since the tangential E fields on a perfectly conducting surface, such as the conducting part of the array elements, must vanish. Therefore, the magnetic current M=−nxE exists only on the slot aperture of the array elements.

Figure 8B:
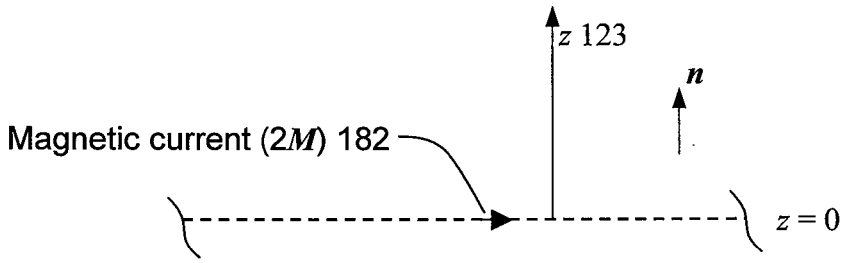
FIG. 8B is representation of planar array of FIG. 1 for the half-space above the array by an equivalent magnetic current.

By invoking the image theorem, the electric conducting plane can be replaced by an identical magnetic current M. In FIG. 8B, the equivalent planar array in FIG. 8A is further reduced, for the fields in the half-space above the array, to a simpler form by combining these two magnetic current sheets into a single current sheet 2M, labeled as 182.

The time-harmonic magnetic field in the far zone for the half-space above the array can be totally attributed to the equivalent magnetic current 2M in FIG. 8B, and is given by $$H(r) = \frac{-jke^{-jkr}}{4\pi\eta r}\int_S 2M(r')e^{jk\hat{r}\cdot r'}ds' \text{ for } z>0 \tag{2}$$

where k=2π/λ, λ is the wavelength of the TW, and η is the free-space wave impedance equal to $\sqrt{\mu_o/\epsilon_o}$ or 120π. The primed unprimed and primed position vectors, r and r', with magnitudes r and r', respectively, refer to field and source points, respectively, in the field and source coordinates. (All the "primed" symbols refer to the source.) The symbol r̂ represents a unit vector in the direction of the field position vector r. S is the plane at z=0. The electric field in the far zone in a limited region can be considered to be a plane wave, and thus is given by $$E(r)=\eta\hat{r}\times H \text{ for } z>0 \tag{3}$$

Now, the TW array elements are of the planar FI 2-D structure which supports the desired radiation according to Eqs. (2) and (3). Note here that the sources, fields, and the Green's function involved here are all complex quantities. Therefore, radiation will be effective only if the integrand in Eq. (2) is substantially in phase; and the radiation must also be in an orderly manner in order to yield a useful radiation pattern. For maximum radiation desired, good impedance matching is essential. Based on antenna theory, and specialized to the present problem in Eqs. (2) and (3), a useful antenna radiation pattern is directly related to its source currents. Therefore, it is advantageous to design the broadband planar array from known broadband antenna configurations, such as the TW antennas discussed here, rather than by approaches starting with a narrowband antenna or unknown design and then trying to broadband it.

Figure 9:
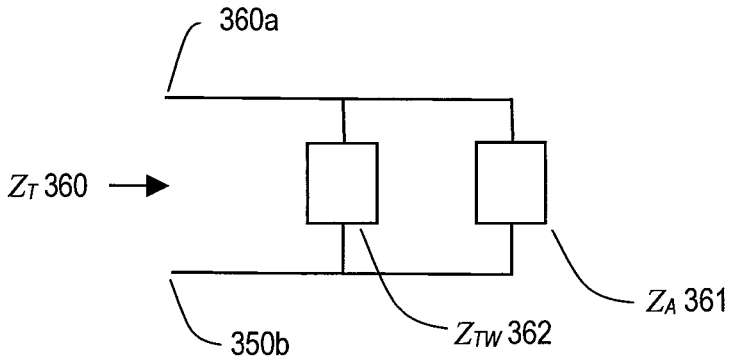
FIG. 9 is an equivalent circuit at the array element feed terminals for the array of FIGS. 1 and 2.

For impedance matching, an equivalent circuit for the TW array structure, at the array element feed terminals and looking outward to array elements 200, is shown in FIG. 9. At the array element feed terminals 360*a* and 360*b*, the active element impedance $Z_T$, labeled 360, can be represented as a parallel combination of an impedance $Z_A$, 361, for the array elements 200 in the presence of the ground plane 120, plus an impedance $Z_{TW}$, 362, for the transmission lines formed by the TW array structure array elements 200. For planar FI antennas and the associated TW structures, their broadband impedance property of $Z_A$, 361 and $Z_{TW}$ 362 has been discussed by Wang (2000) and Wang et al (2006), which can be adapted to the present array design.

Figure 10:
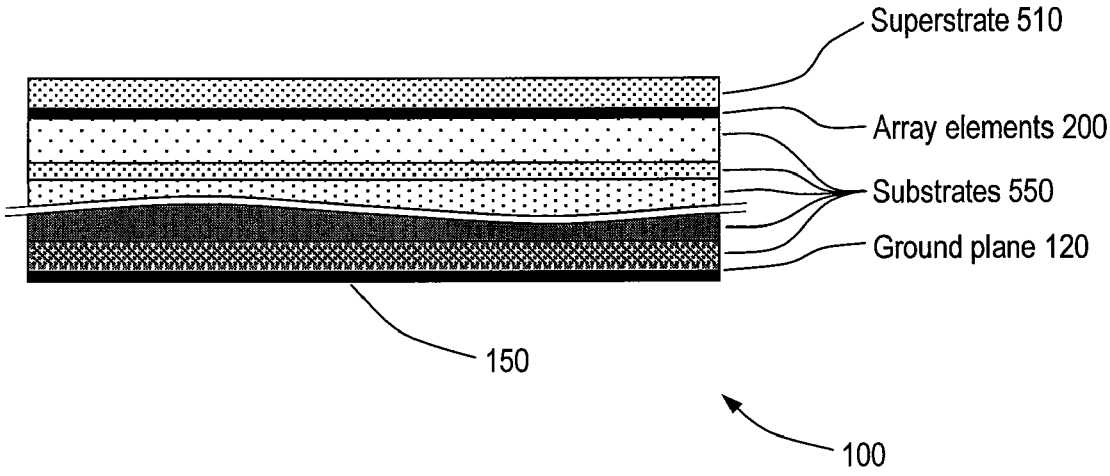
FIG. 10 is a cross-sectional view of planar array with layers of dielectric or magneto-dielectric superstrates and substrates.

The impedance property of $Z_A$, 361 and $Z_{TW}$ 362, as well as radiation properties such as broadening of the scan angle, can also be improved by employing layers of dielectric or magneto-dielectric substrates of various permittivity or permeability (between array elements 200 and ground plane 120) and superstrates (above array elements 200), as shown in a cross-sectional view of such a planar array in FIG. 10.

Further impedance matching can of course be achieved in the feed and beam-steering network 150.

Experimental Verification

Basic experimentation has been performed for this invention. A breadboard 5×5-cell planar array similar to that in FIGS. 3-5 was designed, fabricated, and tested. Each cell has both x and y directed LP planar dipoles. The vertical center element has a broadband balun feed across its feed terminals (corresponding to 250*b* and 250*d* in FIG. 5). Each of the other 24 vertical LP dipoles has a 100-ohm resistor load. All the 25 horizontal LP dipoles have their feed terminals (corresponding to 250*a* and 250*c* in FIG. 5) floating (open-circuit with no connection to other element or device).

According to the theory and practices in planar arrays, the properties of a large planar array can be determined by measuring its "active element gain pattern," which takes account of the mutual coupling and beam scan of a planar array (Mailloux, 1994; Pozar, 1994). The active gain pattern reveals the scan property of the element antenna, including both impedance matching and radiation pattern. The array gain pattern is then obtained from the active element gain pattern and the array factor. The active element gain pattern of centrally located elements of the array are similar, and can be measured with a small array which is fed only at the center element, with all other elements terminated in matched passive loads.

Measurements on the impedance and active gain pattern of the model indicate that this array has a 10:1 bandwidth potential. Another breadboard planar array model empirically studied, showing broadband potential, was a 113-element array with unit elements of the type shown in FIG. 7E.

Variation and Alternative Forms of the Invention

Although adjacent array elements shown are directly connected electrically, the direct connection can be replaced with indirect, yet strong, coupling for certain performance features or to adapt to particular element antenna configurations.

Although the array is planar, it can be slightly curved, either to expand its performance features or to conform to a mounting platform.

Layers of dielectric or magneto-dielectric substrates (between array elements 200 and ground plane 120) and superstrates (above array elements 200) can be used to improve the performance and broaden its frequency bandwidth and scan angle. FIG. 10 is a cross-sectional view of such a planar array implemented with layers of dielectric or magneto-dielectric superstrates and substrates of various permittivity or permeability.

The invention claimed is:

1. A broadband phased array antenna comprising:

a conducting ground surface;

an array of broadband traveling-wave antenna elements positioned generally parallel to said ground surface and spaced less than 0.5 wavelength apart from said ground surface at the highest operating frequency and more than 0.01 wavelength at the lowest operating frequency, each traveling-wave antenna element comprising at least one pair of sub-elements and being connected with a cluster of medial feed lines, one for each sub-element, wherein said array antenna radiates in a direction above said array antenna and its ground surface, adjacent antenna elements being electrically coupled and impedance-matched with each other to facilitate propagation and radiation of traveling-wave in said array antenna.

2. The broadband phased array antenna of claim 1 wherein said adjacent antenna elements are connected with each other.

3. The broadband phased array antenna of claim 1 wherein the ground surface and the phased array elements are planar.

4. The broadband phased array antenna of claim 1 wherein the centers of adjacent antenna elements being spaced sufficiently close to accommodate the desired maximum beam scan angles.

5. The broadband phased array antenna according to claim 1 wherein the traveling-wave antenna element is of a frequency-independent antenna truncated to fit the unit cell of the phased array and configured for impedance matching to the traveling-wave array and efficient broadband radiation.

6. The broadband phased array antenna according to claim 1 wherein the traveling-wave antenna element is one of a plurality of self-complementary antennas truncated to fit the unit cell of the phased array and configured for impedance matching to the traveling-wave array and efficient broadband radiation.

7. The broadband phased array antenna according to claim 1 wherein each traveling-wave antenna element comprises two orthogonal pairs of sub-elements and the feed portion of each traveling-wave antenna element comprises two pairs of balanced transmission lines, one pair for each pair of orthogonal sub-elements, to support dual-orthogonal linear or circular polarization.

8. A broadband phased array antenna comprising:

a conducting ground surface;

an array of broadband traveling-wave antenna elements positioned parallel to said ground surface and spaced less than 0.5 wavelength apart from said ground surface at the highest operating frequency and more than 0.01 wavelength at the lowest operating frequency, each traveling-wave antenna element comprising a medial feed, wherein said array antenna radiates in a direction above said phased array antenna and said ground surface, adjacent antenna elements being electromagnetically coupled or connected; and one or more layers of dielectric or magneto-dielectric substrates and superstrates of various permittivity and permeability to further improve impedance matching and radiation properties for the planar traveling-wave structure in the array antenna.

9. The broadband phased array antenna according to claim 8 wherein the traveling-wave antenna element is of a frequency-independent antenna truncated to fit the unit cell of the phased array and configured for impedance matching to the traveling-wave array and efficient broadband radiation.

10. The broadband phased array antenna according to claim 8 wherein the traveling-wave antenna element is of a self-complementary antenna truncated to fit the unit cell of the phased array and configured for impedance matching to the traveling-wave array and efficient broadband radiation.

11. The broadband phased array antenna according to claim 8 wherein each traveling-wave antenna element comprises two orthogonal pairs of sub-elements and the feed portion of each traveling-wave antenna element comprises two pairs of balanced transmission lines, one pair for each pair of orthogonal sub-elements, to support dual-orthogonal linear or circular polarization.

12. The broadband phased array antenna according to claim 8 wherein at least one of said dielectric or magneto-dielectric substrates is of an artificial material, including a metamaterial, having a desired permittivity and permeability over a range of operating frequencies.

* * * * *